United States Patent [19]

Imai et al.

[11] Patent Number: 4,924,585

[45] Date of Patent: May 15, 1990

[54] METHOD AND APPARATUS FOR CONTINUOUS COMPRESSION FORGING OF CONTINUOUSLY CAST STEEL

[75] Inventors: Takuo Imai; Shinji Kojima; Toshitane Matsukawa; Toshio Fujimura, all of Okayama, Japan

[73] Assignee: Kawasaki Steel Corp., Japan

[21] Appl. No.: 342,705

[22] Filed: Apr. 21, 1989

Related U.S. Application Data

[63] Continuation of Ser. No. 71,412, Jul. 9, 1987, abandoned.

[30] Foreign Application Priority Data

Sep. 4, 1986 [JP] Japan ..... 61-206693
Jan. 30, 1987 [JP] Japan ..... 62-18721

[51] Int. Cl.[5] ..... B21B 1/46

[52] U.S. Cl. ..... 29/527.5; 29/527.7; 164/468; 164/476

[58] Field of Search ..... 29/527.5, 527.7; 164/468, 476

[56] References Cited

U.S. PATENT DOCUMENTS

| | | | |
|---|---|---|---|
| 3,491,824 | 1/1970 | Tarman et al. | 164/476 X |
| 3,747,664 | 7/1973 | Schoffmann | 164/476 |
| 3,837,207 | 9/1974 | Tarmann | 29/527.7 X |
| 3,974,559 | 8/1976 | Kawana et al. | 29/527.7 |
| 4,519,439 | 5/1985 | Fredriksson et al. | 164/476 |
| 4,687,047 | 8/1987 | Ogibayashi et al. | 29/527.7 X |

FOREIGN PATENT DOCUMENTS

| | | | |
|---|---|---|---|
| 532896 | 11/1956 | Canada | 164/468 |
| 59-159934 | 9/1984 | Japan | 164/468 |
| 59-202145 | 11/1984 | Japan | 164/476 |
| 60-148651 | 8/1985 | Japan | 164/468 |
| 61-189850 | 8/1986 | Japan | 164/476 |
| 1174849 | 12/1969 | United Kingdom | 164/476 |

*Primary Examiner*—Carl J. Arbes
*Attorney, Agent, or Firm*—Austin R. Miller

[57] ABSTRACT

A segregation preventive or eliminative operation in a continuous casting process is performed under the following conditions:

The solidified/unsolidified ratio of the solidifying block is in a range of 0.5:1 to 0.9:1;

The ratio between the overall compression δ (mm) versus thickness of the unsolidified area in the block (d mm) is greater than or equal to 0.5 or the thickness (d mm) of the unsolidified layer in the solidifying block is:

$$1.2 \times \sqrt{D - 80} < d < 10.0 \times \sqrt{D - 80}$$

where D is the thickness of the block before compression. Casting speed may be controlled according to thickness of the solidifying shell at or near a crater end. Preferably, electromagnetic stirring is performed before performing compression forging.

36 Claims, 5 Drawing Sheets

METHOD AND APPARATUS FOR CONTINUOUS COMPRESSION FORGING OF CONTINUOUSLY CAST STEEL

This application is a continuation, of application Ser. No. 071,412, filed 7/9/87, now abandoned.

BACKGROUND OF THE INVENTION

1. Field of the Invention

The present invention relates generally to a continuous casting technic. More specifically, the invention relates to a method and apparatus for continuously performing compressive forging for cast steel derived from a continuous casting process.

2. Description of the Background Art

In the conventional art, it has been regarded in inevitable to form central segregation in a continuously cast steel. This segregation is caused by condensation of carbon (C), sulfur (S) and phosphorus (P) in the molten metal near the central axis of the cast steel during the cooling and solidifying process. Such segregation degrades the cast blocks. Particularly, in case of thick steel plate, such segregation in the cast steel may degrade the mechanical properties by causing stratification or layering lamination.

Segregation in cast steel is caused at the final stage of solidification due to the solidification shrinkage or bulging of the solidifying shell which draw the condensed molten metal to the solidifying end and results in central segregation.

In order to eliminate central segregation in the cast steel, various techniques have been attempted. For example, one technique attempted to electromagnetically stir the metal in the secondary cooling zone. However, such attempts failed to completely eliminate segregation at the semi-micron level and therefor are not yet satisfactory.

On the other hand, an in-line reduction method, in which the solidifying end is compressed during the solidification period by means of a pair of rollers has been proposed in "Iron and Steel" Vol. 7, 1974, pages 875 to 884. In this in-line reduction method, it is also required to compress the solidifying block during the stage where the solidifying block contains a relatively large proportion of unsolidified steel. If the force of this compression is not sufficiently great, cracks can form at the interface between the solidified steel and the still molten portion. On the other hand, when compression at the aforementioned solidifying stage is excessive, inversely segregated areas in which certain components of the desired alloy are missing can be created at the center of the cast steel during the compression process.

In order to avoid the aforementioned defects, the Japanese Patent First (inexamined) Publication 49-12738 discloses a method for compensating for reduction of volume of the solidifying cast steel by reducing gaps between pairs of rolls. On the other hand, the Japanese Patent First Publication (Tokkai) Showa 53-40633 discloses a method for performing heavy compression by means of a casting die at the end stage of solidification. The improvement for the method of Tokkai Showa 53-40633 has been proposed in the Japanese Patent First Publication (Tokkai) Showa 60-148651, in which electromagnetic stirring is performed, or ultrasonic waves are applied to the solidifying steel during the solidification. This process along with substantial compression by means of the casting die during the solidification stage helps to reduce segregation.

However, in the former case as disclosed in Tokkai Showa 49-12738, bulging and other defects cannot be completely avoided even when pairs of rolls are provided to reduce the gaps between them as several mm/m. In addition, in this case, when the position of the rollers is not appropriate, the light compression process may actually degrade the cast steel by creating worse segregation around the center. On the other hand, in the later case, heavy compression by means of the casting die may cause internal cracks of the solidifying steel and generate inversely segregated areas. However, the improvement in the semi-macro segregation can be achieved, this method requires quite delicate adjustment of the compression conditions. Namely, when the heavy die compression is performed at a stage in which a relatively large proportion of unsolidified steel exists, it is possible to create cracks at the interface between the solidified section and the unsolidified section. Still worse, if the heavy die compression is applied while a relatively large proportion of unsolidified metal is left, an inversely segregated area can be formed. On the other hand, if such compression is performed at a stage when an excessively small proportion of unsolidified metal is left, compression is not so effective in avoiding segregation. By performing electromagnetic stirring or by applying ultra-sonic waves, centerline segregation can be reduced by increasing the uni-directional crystalline orientation. However, it is still not satisfactory for avoiding creation of the centerline segregation and so forth for a wide range and variety of thicknesses, casting speeds, temperatures and so forth encountered when forming a steel block.

SUMMARY OF THE INVENTION

Therefore, it is a principle object of the present invention to provide a method and apparatus which can successfully and satisfactorily avoid creation of segregation in the continuously cast steel.

In order to accomplish the aforementioned and other objects, a segregation prevention or elimination operation, performed in accordance with the invention, is carried out under the following conditions:

the ratio of solidified/unsolidified metal solidifying block at the point of measurement is a range of 0.5:1 t 0.9:1:

The ratio between the thickness δ (mm) of the unsolidified (liquidus) section at the center of the steel block and the amount d (mm) of total reduction in thickness of the steel block at the point of measurement during compression forging should be greater than s/d 0.5:1.

In another embodiment, the thickness d (mm) of the unsolidified (liquidus) layer in the solidifying block is:

$$1.2\times D-80<d<10.0\times D-80$$

Where D is the thickness of the steel block in millimeters before compression.

Preferably, the casting speed is to be controlled according to the thickness of the solidified (solidus) shell at a crater end or near the crater end. Further preferably, electromagnetic stirring is performed before applying compression.

The solid phase ratio ($f_S$) is the ratio of solidified/unsolidified material at the measured section of the steel block measured at the temperature and pressure existing at the time measurement.

In the disclosure, the word "interface" refers to that area between the solidified (solidus) material of the block and the still unsolidified material thereof.

According to one aspect of the invention, a method for compression forging on a cast steel block drawn from a casting mold in a continuous casting process comprises the steps of:

providing a means for applying forging compression for the cast steel block;

orienting the forging compression means at a position where the solid phase ratio of the steel block is in a range of 0.5:1 to 0.9:1 and where the thickness reduction of the cast steel block through the forging compression satisfies the following formula:

$$\delta/d \geqq 0.5$$

where

δ is the overall reduction (mm) of thickness of the cast block during where reducted by forging compression; and d is the thickness (mm) of the unsolidified layer in the cast block at the position where forging compression is performed.

Alternatively, according to another aspect of the invention, a method for compressing a cast steel block drawn from a mold in a continuous caster comprises the steps of:

providing a means for applying compression forging on the cast steel block;

orienting the compression forging means at an position of the cast steel block in which a given ratio of unsolidified layer is left, the thickness (d) is:

$$1.2 \times \sqrt{D-80} \leqq d \leqq 10.0 \times \sqrt{D-80}$$

where D is the overall thickness (mm) of the cast steel block before compression, and the ratio of thickness reduction (δ mm) versus thickness of unsolidified layer (d mm) is greater than or equal to 1.0.

Preferably, the method further comprises a step of exerting a stirring force on the cast block in advance of performing compression forging. On the other hand, the method may further comprise the steps of:

monitoring the thickness of the unsolidified layer in the cast steel block at the crater end or near the crater end; and adjusting the casting speed of the continuous caster so that the solid phase ratio at the forging compression stage is kept in the range of 0.5:1 to 0.9:1.

An electromagnetic stirring force is exerted on the cast steel block in the stirring step. The electromagnetic stirring is performed at a frequency between 0.1 to 20 Hz, the magnetic flux density is in the range of 200 to 1600 gauss, while the solid phase ratio is in the range of 0 to 0.8 and/or where the thickness (d) of the unsolidified layer is in the range of:

$$2.0 \times \sqrt{D-80} \leqq d \leqq 14.0 \times \sqrt{D-80}\ .$$

According to a further aspect of the invention, an apparatus is provided for compression forging a cast steel block drawn from a mold in a continuous casting process and comprises:

means for receiving a cast steel block from the continuous caster and feeding the same to a forging means;

means for applying compression forging on the cast steel block, the forging compression means being at a position where the solid phase ratio of the block is in a range of 0.5:1 to 0.9:1 and the thickness reduction of the cast block via compression forging satisfies the following formula:

$$\delta/d \geqq 0.5$$

where

δ is the overall reduction (mm) of thickness of the cast block where reduced by compression forging; and d is the thickness (mm) of the unsolidified layer in the cast block at the position where compression forging is performed.

According to still another aspect of the invention, an apparatus for compression forging a cast steel block drawn from a mold in a continuous caster comprises:

means for receiving a cast steel block from the continuous caster and feeding the same to a compression forging means;

the compression forging means being oriented at a position of the block where the cast steel block has a given ratio of solidified to unsolidified metal, the thickness of the unsolidified layer (d) which is in a range of:

$$1.2 \times \sqrt{D-80} \leqq d \leqq 10.0 \times \sqrt{D-80}$$

where

D is the overall thickness of the block before compression, and the ratio of thickness reduction of the block (δ mm) versus thickness of the unsolidified layer of the block (d mm) is greater than or equal to 1.0.

In the preferred construction, the apparatus, set forth above may further comprise means provided upstream of the compression forging means for exerting stirring force on the cast steel block in advance of applying forging compression. The stirring means performs electromagnetic stirring on the cast steel block in the stirring step. The conditions for performing electromagnetic stirring are that:

the frequency is 0.1 to 20 Hz;

the magnetic flux density is in the 200 to 1600 gauss range;

the solid phase ratio is in the 0 to 0.8 range; and/or the thickness (d) of unsolidified layer is:

$$2.0 \times \sqrt{D-80} \leqq d \leqq 14.0 \times \sqrt{D-80}\ .$$

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
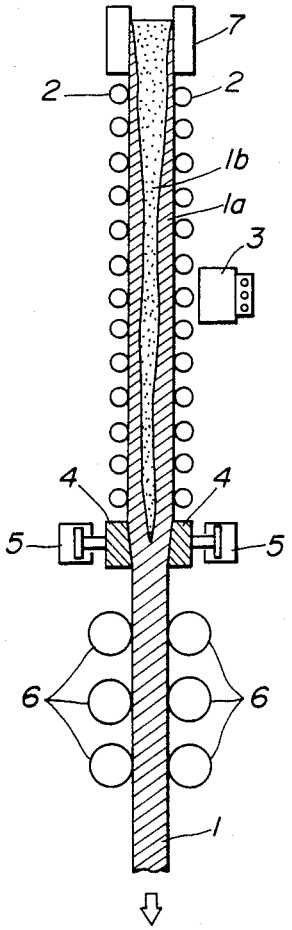
FIG. 1 is a schematic illustration showing the preferred embodiment of a continuous forging apparatus according to the invention.

Referring now to the drawings, particularly to FIG. 1, the preferred embodiment of a segregation preventive compression forging apparatus, according to the present invention, is arranged in series with a continuous caster which includes a mold 7. The apparatus comprises a pair of guide rollers 2 defining a path for cast steel block 1, such as cast strip, cast slab and so forth. The cast steel block path extends from the end of the casting mold 7 to a forging compression stage, where a pair of forging compression dies 4 are provided. An electromagnetical stirring device 3 is arranged adjacent the cast steel block path at an intermediate position between the end of the casting mold 7 and the compression forging means. Pairs of pinch rollers 6 are provided at downstream of the compression forging stage for drawing the block.

The compression forging dies 4 are respectively associated with power cylinders 5 which drive the compression forging dies toward and away from the cast steel block to be compressed. The power cylinders 5 may be adjusted according to the type of cast steel block, temperature of the block and so forth.

As will be seen from FIG. 1, the preferred construction of the segregation preventive compression forging apparatus, according to the invention, arranges the forging compression dies 4 at a orientation where the solid phase ratio ($f_s$) is in a range of 0.5:1 to 0.9:1, and the ratio of compressive reduction (δ mm) versus the thickness of the unsolidified layer (d mm) is greater than or equal to 0.5. The segregation preventive compression forging apparatus, arranges the forging compression dies 4 at a position where the thickness (d mm) of the unsolidified layer is:

$$1.2 \times \sqrt{D - 80} \leqq d \leqq 10.0 \times \sqrt{D - 80}$$

where D is overall thickness (mm) of the cast steel block before compression, and the ratio of compressive reduction (δ mm) versus thickness of unsolidified layer (d mm) is greater than or equal to 0.5:1.

Figure 2:
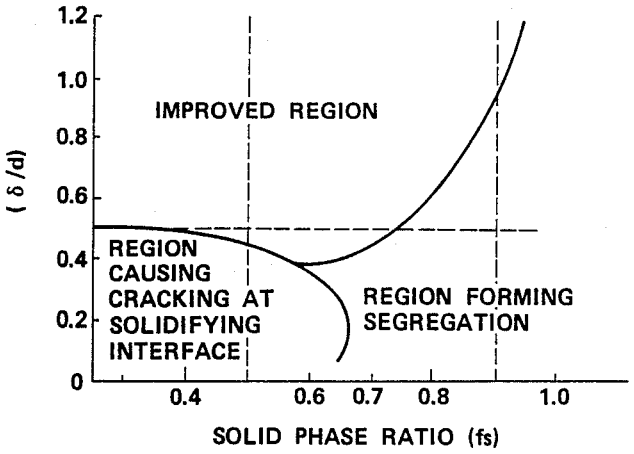
FIG. 2 is a graph showing the relationship between the ratio of compressingly reduced thickness and the thickness of the unsolidified layer and solid phase ratio.
Figure 3:
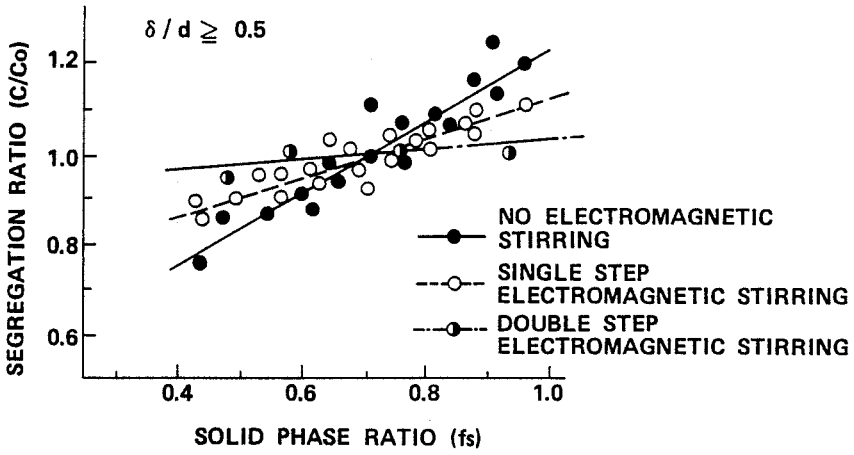
FIG. 3 is a graph showing the relationship between segregation ratio and the solid phase ratio.

In order to obtain the aforementioned optimal position of the compression forging stage, experiments were performed at various solid phase ratios ($f_s$), thickness of the unsolidified layer (d) and thickness reduction amounts (δ). The results of the experiments are shown in FIGS. 2 and 3. In FIG. 2, there is shown the variation (δ/d) of block thickness reduction versus thickness of the unsolidified layer, in relation to the solid phase ratio at the central portion of the cast steel block 1. From FIG. 2, it will be appreciated:

that, when the thickness (d) of the unsolidified layer is excessively great and thus the ratio (δ/d) is smaller than 0.5, cracking occurs at the interface between the solidified and unsolidified metals; and that the thickness (d) of the unsolidified layer is small and thus the ratio (δ/d) is substantially great, therefore prevention of segregation becomes difficult.

In the former case, it is believed that cracking at the interface between the solid phase and liquid phase occurs due to excessive compression of the cast steel block. On the other hand, in the latter case, when the solid phase ratio ($f_s$) becomes greater than or equal to 0.7, reduction of segregation occurring around the center of the cast steel block becomes difficult. When the solid phase ratio ($f_s$) is greater than or equal to 0.9 or in other words the cast steel block is nearly solid, extremely high pressure is required to reduce segregation therein.

FIG. 3 shows variation of carbon segregation ratio ($C/C_0$) in the cast steel block relative to the solid phase ratio ($f_s$). Here, C represents the carbon content in a sample obtained from cast steel block, and $C_0$ *is an average carbon content in the cast steel block. As will be seen from FIG. 3, the ratio* $C/C_0$ become substantially 1.0 at a solid phase ratio ($f_s$) about 0.7. Therefore, in view of the carbon segregation ratio ($C/C_0$), the preferred solid phase ratio becomes about 0.7.

In view of the required quality and properties of the cast products, the carbon segregation ratio ($C/C_0$) and the reduction ratio (δ/d), the optimum range of the solid phase ratio is 0.5 to 0.9.

Figure 4:
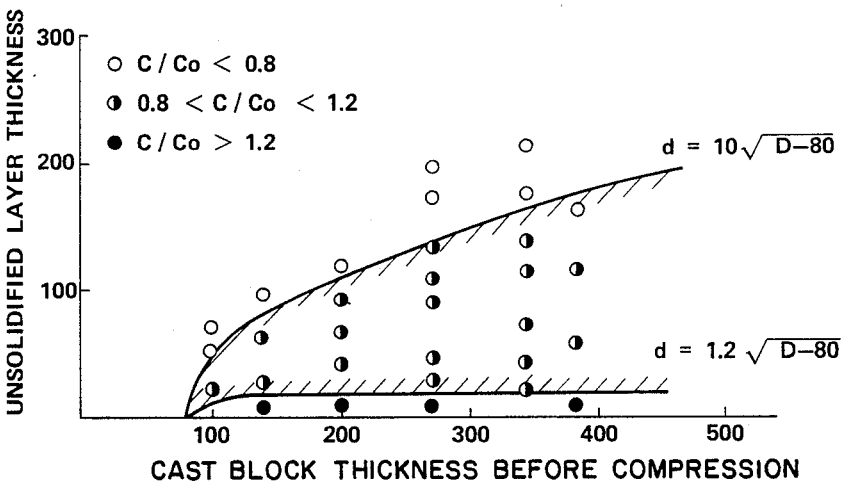
FIG. 4 is a graph showing the relationship between unsolidified layer in the cast steel block and the thickness of the cast block before compression.

On the other hand, as will be appreciated, in practice it is difficult to control the solid phase ratio ($f_s$) in a continuous casting operation. In order to enable practical control, observation is needed of the thickness of the cast steel block obtained, the thickness of the unsolidified layer at the center of the cast steel block and the types of the cast steels to be produced. FIG. 4 shows the variation in the thickness (d mm.) of the unsolidified layer realtive to the cast steel block thickness before compression, when thickness reduction is performed at a condition where the ratio δ/d is greater than or equal to 0.5. The graph of FIG. 4 represents carbon segregation distribution relative to the thickness of the unsolidified layer (d) and thickness of the cast steel block (D).

As will be seen in FIG. 4, where the unsolidified layer thickness d falls within a range described by:

$$1.2 \times \sqrt{D - 80} \leqq d \leqq 10.0 \times \sqrt{D - 80}$$

the solid phase ratio ($f_s$) remains within the range of 0.5:1 to 0.9:1. Therefore, by setting the unsolidified layer thickness (d) (mm) relative to the cast steel block thickness (D) in the range set forth above, compression forging can be performed while the solid phase ratio ($f_s$) is within the range of 0.5:1 to 0.9:1.

In order to effectively perform compression forging for reducing segregation in the cast steel block, it is essential to arrange the forging means at an optimal position. Therefore, it is quite important to control the location of the solidification point during continuous casting. Therefore, it is desirable to monitor the thickness of the solidified shell 1*a* of the cast steel block 1 at the crater end or near the crater end and control the casting speed so that the solid phase ratio ($f_s$) and the unsolidified layer thickness d can be maintained within the ranges set forth above.

On the other hand, as set forth in the introduction of the disclosure, applying electromagnetic stirring force before compression forging is performed is effective for reducing segregation in the cast steel block. Therefore, as seen in FIG. 1, the preferred embodiment of the segregation preventing compression forging apparatus according to the present invention, employs an electromagnetic stirring device 3 upstream of the compression forging means where the compression forging dies 4 are provided. In a practical embodiment, electromagnetic stirring is performed at a frequency in the 0.1 to 20 Hz range, and a magnetic flux density B at the surface of the cast block in the 200 to 1600 gauss range. For this purpose, circumferential horizontal or vertical electromagnetic stirring is performed by means of the device 3.

In order to determine the optimum position of the electromagnetically stirring device 3, experiment are performed at positions:

in the mold 7 of the continuous caster;

at a position where the solid phase ratio ($f_s$) at the center of the cast block 1 is about 0 to 0.8;

and at a position where the thickness of the unsolidified layer thickness is:

$$2.0 \times \sqrt{D-80} \leqq d \leqq 14.0 \times \sqrt{D-80}\ .$$

Figure 5:
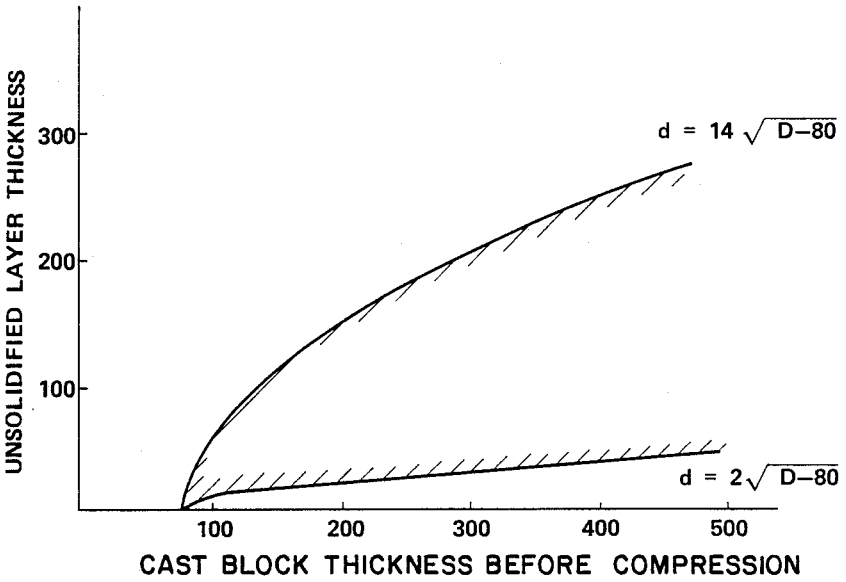
FIG. 5 is a graph showing the relationship between unsolidified layer in the cast steel block and the thickness of cast block before forging compression.

As a result of the aforementioned experiment, the optimal position of the electromagnetic stirring means as shown in FIG. 5 is:

$$2.0 \times \sqrt{D-80} \leqq d \leqq 14.0 \times \sqrt{D-80}\ .$$

Highly uniform fine crystalline structure can be obtained in the cast steel block can be obtained when the above equation is satisfied.

It should be noted when the frequency of electromagnetic stirring is less than 0.1 Hz, stirring cannot be performed effectively. On the other hand, when the frequency is in excess of 20 Hz it will not penetrate deeply enough into the cast steel block and can not provide the necessary stirring force. When the magnetic flux density is less than 200 Gauss, an adequate stirring force can not be obtained, and when the magnetic flux density is in excess of 1600 Gauss, the stirring force becomes too great causing flow of the molten metal in the cast steel block and generating inversely segregated areas.

It should be appreciated that, though the shown embodiment provides a single electromagnetic stirring stage, it would be more effective to provide several electromagnetic stirring stages.

Figure 6:
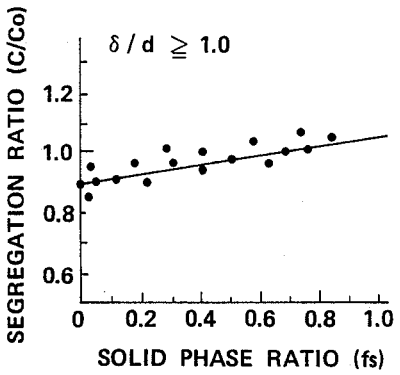
FIG. 6 is a graph showing the variation of segregation ratio in relation to solid phase ratio.
Figure 8:
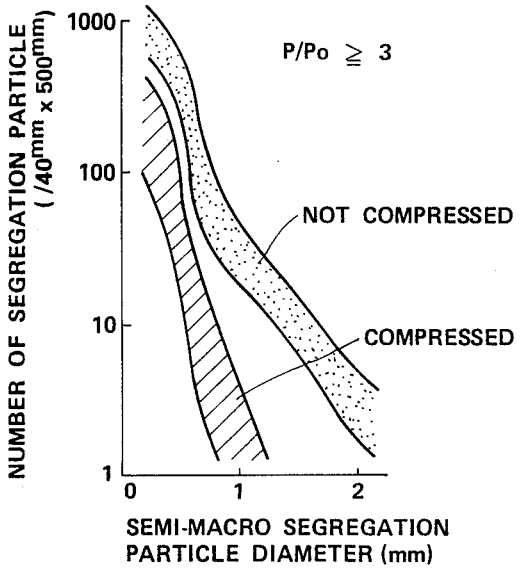
FIG. 8 is a graph showing the variation of number of segregated particles and particle size thereof, showing the result of an example 2.

On the other hand, as seen in FIG. 2, when the high ratio of thickness reduction is performed in the compression forging stage, segregation can be reduced even when the thickness of the unsolidified layer is relatively great. Specifically, as shown in FIG. 6, when the acceptable quality is 0.9±0.1 with regard to the carbon segregation ratio ($C/C_0$), the desired quality of cast steel block can be obtained by performing compression forging at an δ/d ratio greater than or equal to 1.0 regardless of the solid phase ratio. Therefore, it should be appreciated that by performing relatively high reduction ratio compression forging, substantial improvement can be obtained regardless of the position of the compression stage.

EXAMPLE 1

Continuous casting of a cast block 1 of 270 mm thickness and 2,200 mm width was performed by means of a per se well known type of continuous caster. The cast steel block 1 was processed by means of the preferred embodiment of the segregation preventive compression forging apparatus of FIG. 1. After compression forging, the block (SM 50) was 220 mm. in thickness and 2,240 mm. in width.

The composition of the steel block is shown in the appended table 1. Compression forging was performed under the following conditions:

solid phase ratio $f_s=0.7$ reduction ratio $\delta/d=0.9$.

Casting speed was controlled at 0.7 m/min. so that the solid phase ratio ($f_s$) could be maintained at 0.7 which corresponded to the thickness, about 50 mm of the unsolidified layer. In addition, electromagnetic stirring was performed under the following conditions:

solid phase ratio $f_s=0.7$ and 0.74 unsolidified layer thickness d=80 mm and 60 mm.

$$1.2 \times \sqrt{D-80} \leqq d \leqq 10.0 \times \sqrt{D-80}$$

Electromagnetic stirring parameters are set out in the appended table 2.

Carbon segregation ratio $C/C_0$ is checked with respect to the resultant cast block. The carbon segregation ratio $C/C_0$ obtained was 0.98. This demonstrates the high potential of the preferred embodiment of the segregation preventive compression forging apparatus of the present invention.

Figure 7:
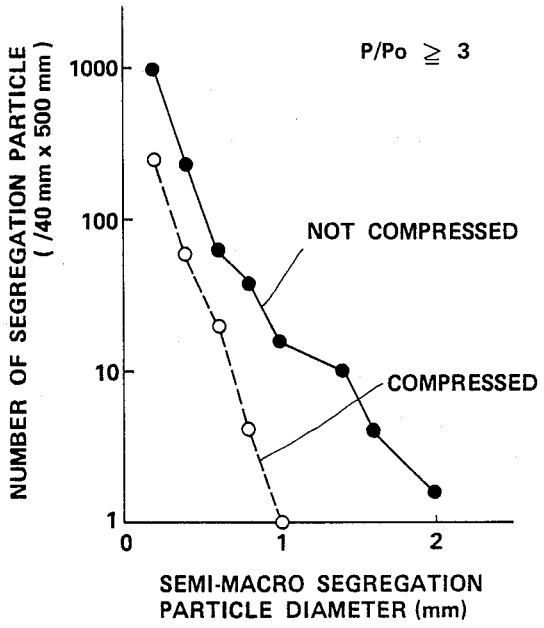
FIG. 7 is a graph showing the variation of number of segregated particles and particle sizes thereof, showing the result of an example 1.

The cast steel block obtained from the aforementioned compression process was further checked with respect to particle size and particle number of semi-macro segregation. In order to check the above, the resultant cast steel block is separated into 200 μm mesh blocks. Average phosphorus (P) concentration in respective mesh blocks was measured. In order to compare the results of measurements of the forging compression forged cast steel block, the same measurement was performed for cast block, on which no compression forging process was performed. The results of the measurements are shown in FIG. 7.

It should be noted that the expression P/Po is a conventional representation of the ratio wherein Po represents the average phosphorus concentration in the cast block and P represents the overage phosphorus concentration in the 200μm mesh materials. The ordinate designation "/40 mm×50 mm" represents the central rectangular area in which the P/Po ratio was tested FIG. 7 shows the semi-macro segregation particle size and particle number of the blocks which had a segregation ratio greater than or equal to 3. As will be seen in FIG. 7, segregation can be reduced by performing compression forging. Reduction of segregation in relatively large particles was particularly marked.

EXAMPLE 2

Under the same conditions as listed above but without electromagnetic stirring, casting and forging compression was performed. The compression forging means was arranged at a position where the unsolidified layer thickness (mm) d was:

$$1.2 \times \sqrt{D-80} \leqq d \leqq 10.0 \times \sqrt{D-80}$$

With respect to the cast steel block, the semi-macro phosphorus segregation was measured in a manner identical to that performed with respect to the former embodiment. As a result, it was found that, though the range of variation in the data is wider that that obtained in the former embodiment, marked reduction of segregation in the cast steel block could still be obtained.

Therefore, the invention fulfills all of the objects and advantages sought thereby.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | | | | (wt %) |
|---|---|---|---|---|
| C | Si | Mn | P | S |
| 0.16 | 10.45 | 1.45 | 0.010 | 0.003 |

TABLE 2

| | | |
|---|---|---|
| Thickness of Unsolidified Layer (mm) | 80 | 60 |
| Frequency (Hz) | 2 | 2 |
| Stirring Direction | Horizontal | Horizontal |
| Magnetic Flux Density | 700 | 700 |

What is claimed is:

1. A method for compression forging a cast block drawn from a mold in a continuous caster comprising the steps of:

providing a means for applying compression forging on said cast block;

orienting said forging compression means at position where the solid phase ratio at the center of the block is in a range of 0.5:1 to 0.9:1 and the thickness reduction of the cast block due to said compression forging satisfies the following formula:

$$\delta/d \geqq 0.5$$

where

δ is the overall reduction (mm) in thickness of the cast block during forging compression; and d is the thickness (mm) of the unsolidified layer in the cast block at the position where forging compression is performed.

2. A method as set forth in claim 1, which further comprises the step of exerting a stirring force on said cast block in advance of performing compression forging.

3. A method as set forth in claim 1, which further comprises steps of:

monitoring the thickness of said unsolidified layer in said cast block at a crater end or near a crater end; and adjusting the casting speed of said continuous caster so that the solid phase ratio at said forging compression stage is maintained in said range of 0.5:1 to 0.9:1.

4. A method as set forth in claim 3, which further comprises the step of exerting a stirring force on said cast block in advance of performing compression forging.

5. A method as set forth in claim 2, wherein an electromagnetic stirring force is exerted on said cast block in said stirring step.

6. A method as set forth in claim 5, wherein said electromagnetic stirring is performed at a frequency between 0.1 to 20 Hz.

7. A method as set forth in claim 5, wherein said electromagnetic stirring is performed with a magnetic flux density in the range of 200 to 1600 gauss.

8. A method as set forth in claim 5, wherein said electromagnetic stirring is performed while said solid phase ratio is in a range of 0 to 0.8.

9. A method as set forth in claim 5, wherein said electromagnetic stirring is performed while the thickness (dd) (mm) of the unsolidified layer is as follows:

$$2.0 \times \sqrt{D-80} \leqq d \leqq 14.0 \times \sqrt{D-80}.$$

10. A method for compression forging a cast block drawn from a mold in a continuous caster comprising the steps of:

providing a means for applying compression forging on said cast block;

orienting said compression forging means at a position where said cast block has a given ratio of unsolidified layer, the thickness (d) (mm) of which is:

$$1.2 \times \sqrt{D-80} \leqq d \leqq 10.0 \times \sqrt{D-80}$$

where D is the overall thickness (mm) of the cast block before compression, and the ratio of thickness reduction δ versus thickness of the unsolidified layer d (mm) is greater than or equal to 1.0.

11. A method as set forth in claim 10, which further comprises the step of exerting a stirring force on said cast block in advance of performing compression forging.

12. A method as set forth in claim 10, which further comprises the steps of:

monitoring the thickness of said unsolidified layer in said cast block at a crater end or near a crater end; and adjusting the casting speed of said continuous caster so that the solid phase ratio at said compression forging stage is maintained in said range.

13. A method as set forth in claim 12, which further comprises the step of exerting a stirring force on said cast block in advance of performing compression forging.

14. A method as set forth in claim 11, wherein an electromagnetic stirring force is exerted on said cast block in said stirring step.

15. A method as set forth in claim 14, wherein said electromagnetic stirring is performed at a frequency of 0.1 to 20 Hz.

16. A method as set forth in claim 15, wherein the magnetic flux density of said electromagnetic stirring is in a range between 200 to 1600 gauss.

17. A method as set forth in claim 14, wherein said electromagnetic stirring is performed while said solid phase ratio is in a range of 0:1 to 0.8:1.

18. A method as set forth in claim 15, wherein said electromagnetic stirring is performed while the thickness (d) (mm) of the unsolidified layer is:

$$2.0 \times \sqrt{D-80} \leqq d \leqq 14.0 \times \sqrt{D-80}\ .$$

19. A method as set forth in claim 10, wherein the ratio of compressive reduction δ (mm) versus thickness of unsolidified layer d (mm) is greater than or equal to 0.5.

20. An apparatus for compression forging a cast block drawn from a casting mold in a continuous caster comprising:

means for receiving a cast block from said continuous caster and feeding the same to a compression forging means;

said compression forging means being provided at a position where the solid phase ratio of the block is within a range between 0.5:1 to 0.9:1 and the thickness reduction of the cast block by said compression forging satisfies the following formula:

$$\delta/d \geqq 0.5$$

wherein

δ is the overall reduction (mm) in thickness of the cast block during compression forging; and d is the thickness (mm) of the unsolidified layer in the cast block at the position where compression forging is performed.

21. An apparatus as set forth in claim 20, which further comprises means provided upstream of said compression forging means for exerting a stirring force on said cast block in advance of performing compression forging.

22. An apparatus as set forth in claim 21, wherein said stirring means exerts an electromagnetic stirring force on said cast block in said stirring step.

23. An apparatus as set forth in claim 22, wherein said stirring means performs said electromagnetic stirring at a frequency between 0.1 to 20 Hz.

24. An apparatus as set forth in claim 22, wherein said electromagnetic stirring is performed with a magnetic flux density in a range between 200 to 1600 gauss.

25. An apparatus as set forth in claim 22, wherein said stirring means performs said electromagnetic stirring while said solid phase ratio is in a range of 0:1 to 0.8:1.

26. An apparatus as set forth in claim 22, wherein said stirring means performs said electromagnetic stirring while the thickness (d) (mm) of the unsolidified layer is:

$$2.0 \times \sqrt{D-80} \leqq d \leqq 14.0 \times \sqrt{D-80}\ .$$

27. An apparatus for compression forging a cast block drawn from a mold in a continuous caster comprising:

means for receiving a cast block from said continuous caster and feeding the same to a compression forging means;

said compression forging means being provided at a position where said cast block has an unsolidified layer the thickness (d) (mm) of which is:

$$1.2 \times \sqrt{D-80} \leqq d \leqq 10.0 \times \sqrt{D-80}$$

where D is the overall thickness (mm) of the cast block before compression, and the ratio of thickness reduction (d mm) versus thickness of the unsolidified layer (d mm) is greater than or equal to 1.0.

28. An apparatus as set forth in claim 27, which further comprises means provided upstream of said forging compression means for exerting a stirring force on said cast block in advances of performing compression forging.

29. An apparatus as set forth in claim 28, wherein said stirring means exerts an electromagnetic stirring force on said cast block in said stirring step.

30. An apparatus as set forth in claim 29, wherein said stirring means performs said electromagnetic stirring at a frequency between 0.1 to 20 Hz.

31. An apparatus as set forth in claim 29, wherein said electromagnetic stirring is performed with a magnetic flux density in a range between 200 to 1600 gauss.

32. An apparatus as set forth in claim 29, wherein said stirring means performs said electromagnetic stirring while said solid phase ratio is in a range between 0 to 0.8.

33. An apparatus as set forth in claim 29, wherein said stirring means performs said electromagnetic stirring while the thickness (d) (mm) of unsolidified layer is:

$$2.0 \times \sqrt{D-80} \leqq d \leqq 14.0 \times \sqrt{D-80}\ .$$

34. An apparatus as set forth in claim 27, wherein said compression forging means performs compression forging of said cast block while the ratio of reduction δ (mm) versus thickness of the unsolidified layer (d mm) is greater than or equal to 0.5.

35. A method for compression forging a cast block drawn from a mold in a continuous caster comprising the steps of:

providing means for applying compression forging on said cast block;

orienting said forging compression means at a position where the solid phase ratio at the center of the block is in a range of 0.5:1 to 0.9:1 and the thickness reduction of the cast block due to said compression forging satisfies the following formula:

$$\delta/d \geqq 0.5$$

where δ is the overall reduction (mm) in thickness of the cast block during forging compression; and d is the thickness (mm) of the unsolidified layer in the cast block at the position where forging compression is performed, exerting a stirring force on said cast block; and performing the continuous compression forging subsequently to the step of exerting stirring force.

36. An apparatus for compression forging a cast block drawn from a mold in a continuous caster comprising:

means for applying compression forging on said cast block, said compression means being conducted while orienting said forging compression means at position where the solid phase ratio at the center of the block is in a range of 0.5:1 to 0.9:1 and the thickness reduction of the cast block due to said compression forging satisfies the following formula:

$$\delta/d \geqq 0.5$$

where $\delta$ is the overall reduction (mm) in thickness of the cast block during forging compression;

and d is the thickness (mm) of the unsolidified layer in the cast block at the position where forging compression is performed, and means for exerting a stirring force on said cast block in advance of performing said continuous compression forging.

* * * * *